US009466230B2

(12) United States Patent
Zhai et al.

(10) Patent No.: US 9,466,230 B2
(45) Date of Patent: Oct. 11, 2016

(54) CABLE LABEL

(71) Applicant: ZTE Corporation, Shenzhen (CN)

(72) Inventors: Shixuan Zhai, Shenzhen (CN); Haiyan Qin, Shenzhen (CN)

(73) Assignee: ZTE CORPORATION, Shenzhen (CN)

( * ) Notice: Subject to any disclaimer, the term of this patent is extended or adjusted under 35 U.S.C. 154(b) by 0 days.

(21) Appl. No.: 14/439,031

(22) PCT Filed: Aug. 22, 2013

(86) PCT No.: PCT/CN2013/082100

§ 371 (c)(1),
(2) Date: Apr. 28, 2015

(87) PCT Pub. No.: WO2014/071762

PCT Pub. Date: May 15, 2014

(65) Prior Publication Data

US 2015/0294601 A1 Oct. 15, 2015

(30) Foreign Application Priority Data

Nov. 7, 2012 (CN) ..... 2012 2 0583130 U

(51) Int. Cl.
*G09F 3/00* (2006.01)
*G09F 3/14* (2006.01)

(52) U.S. Cl.
CPC ..... *G09F 3/0295* (2013.01); *G09F 3/14* (2013.01)

(58) Field of Classification Search
CPC ..... G09F 3/0295; G09F 3/00
See application file for complete search history.

(56) References Cited

U.S. PATENT DOCUMENTS 1,350,914 A * 8/1920 Baker ..... G06K 19/00 283/5
4,241,943 A * 12/1980 Malinovitz ..... G07C 1/30 283/102
5,887,368 A * 3/1999 Rupp ..... G06F 3/10 40/316
6,000,258 A 12/1999 Lesko
2002/0092908 A1 * 7/2002 Chumbley ..... G07C 13/00 235/386
2008/0035728 A1 * 2/2008 Peterson ..... G07C 13/00 235/386
2008/0054074 A1 * 3/2008 Quine ..... B42D 15/08 235/386
2013/0193214 A1 * 8/2013 Margulis ..... G06K 19/02 235/489

FOREIGN PATENT DOCUMENTS

CN 2738542 Y 11/2005
CN 201540685 U 8/2010
CN 202282107 U 6/2012
CN 202976978 U 6/2013
KR 20080093272 A 10/2008

OTHER PUBLICATIONS

International Search Report for corresponding application PCT/CN2013/082100 filed Aug. 22, 2013; Mail date Nov. 21, 2013.

* cited by examiner

*Primary Examiner* — Gary Hoge
(74) *Attorney, Agent, or Firm* — Cantor Colburn LLP

(57) ABSTRACT

A cable label (100). At least one through-hole (110) which is set for at least one bundle buckle to pass through and a plurality of knockoff holes (120) are set on the label (100), and the knockoff holes (120) are formed of discontinuous annular kerf (121), and each knockoff hole (120) is provided with an identification. When a cable is marked, it is merely required to knock off an intermediate material (122) of a knockoff hole (120) corresponding to the identification of the cable, which can be used to mark cables with different uses, has high versatility and easy management.

4 Claims, 2 Drawing Sheets

CABLE LABEL

TECHNICAL FIELD

The disclosure relates to the field of electronic technology, and in particular to a cable label.

BACKGROUND

At present, common devices of electronic products on the markets usually have a large amount of cable connections. However, as to the same type of cables, if there are no special marks, it would be easily mixed up and causes misplug and misconnection. A commonly-used method is to add a label at the locations close to two ends and the middle of a cable so as to mark the functions and uses of this cable. Since the uses of many cables need to be determined in field, and different cables may need different labels, the labels have low versatility and are error-prone during usage, which is not convenient for management and has high project installation cost.

SUMMARY

The embodiments of the disclosure provide a cable label, which improves the versatility of the cable label.

In view of the above, an embodiment of the disclosure provides a cable label, wherein the label is set with at least one through-hole for at least one bundle buckle to pass through and the label is further set with a plurality of knockoff holes, and each of the plurality of knockoff holes is a through-hole formed of discontinuous annular kerf after knocking off an intermediate material, and each knockoff hole is set with an identification.

In an example embodiment, at least one part of the discontinuous annular kerf is discontinuous.

In an example embodiment, the identification of each of the plurality of knockoff holes is set in the knockoff hole, near the knockoff hole or to surround the knockoff hole.

In an example embodiment, the label is set with a boss.

In an example embodiment, the boss is located at one end of the label.

The embodiments of the disclosure provide a cable label, wherein the label is set with knockoff holes, and the knockoff holes are formed of discontinuous annular kerf, and each knockoff hole is set with an identification. When a cable is marked, it is merely required to knock off an intermediate material of a knockoff hole corresponding to the identification of the cable, which can be used to mark cables with different uses, has high versatility and easy management.

Realization of objectives, functional characteristics and advantages related to the disclosure will be illustrated in the subsequent descriptions and appended drawings.

DETAILED DESCRIPTION OF THE EMBODIMENTS

The technical solutions of the disclosure are further detailed below in conjunction with accompanying drawings and embodiments. It should be understood that specific embodiments described here are only used for illustrating the disclosure and not intended to limit the disclosure.

Figure 1:
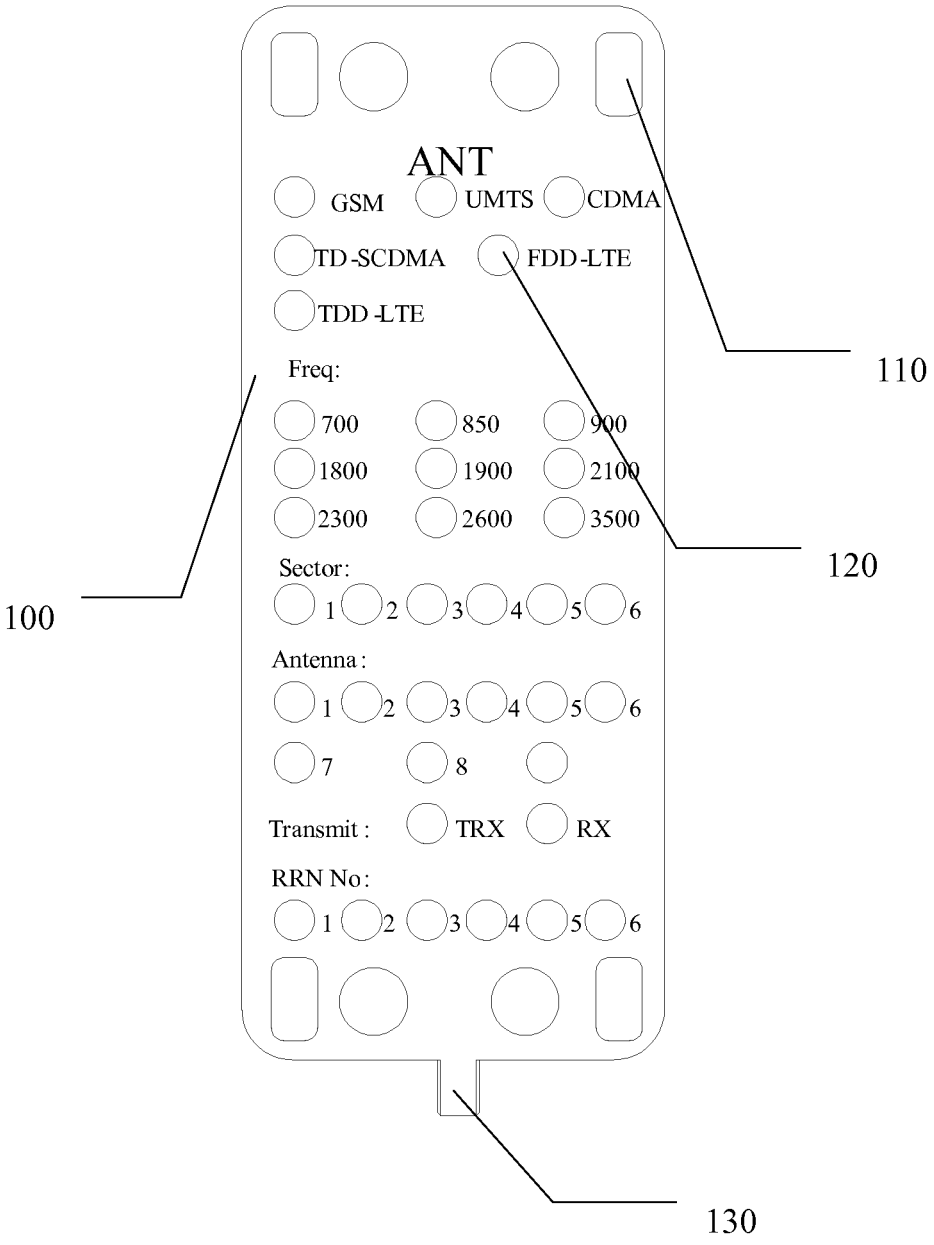
FIG. 1 is a structural schematic diagram showing an example embodiment according to a cable label of the disclosure.
Figure 2:
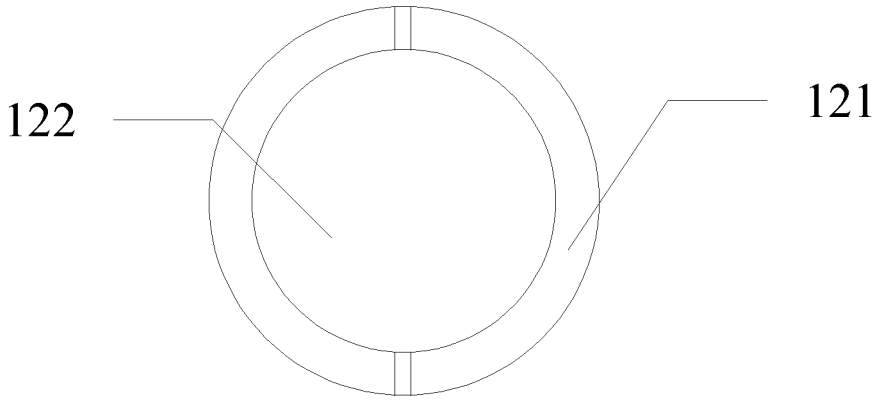
FIG. 2 is an amplified structural schematic diagram showing a knockoff hole according to an embodiment of the disclosure.

With reference to FIG. 1 and FIG. 2, FIG. 1 is a structural schematic diagram of an example embodiment according to a cable label of the disclosure; and FIG. 2 is an amplified structural schematic diagram of a knockoff hole according to an embodiment of the disclosure.

The cable label 100 proposed in the embodiment is set with at least one through-hole 110 for at least one bundle buckle to pass through and is further set with a plurality of knockoff holes 120, and each of the plurality of knockoff holes 120 is a through-hole formed of discontinuous annular kerf 121 after knocking off an intermediate material 122, and each knockoff hole 120 is set with an identification.

Since a plurality of knockoff holes 120 are set on the cable label 100, and the identification of each knockoff hole 120 is different; when the label 100 is needed to mark the uses of the cable, merely the intermediate material 122 of the knockoff hole 120 corresponding to the identification of the cable needs to be knocked off. During usage, the identification corresponding to the through-hole 110 on the cable label 100 is the identification of the cable, and the cable label 100 may be used to mark various cables and has high versatility, and since types of the label 100 are little, it is convenient for installation administration of a project.

In the present embodiment, at least one part of the discontinuous annular kerf 121 of the knockoff holes 120 is discontinuous. During production, the annular kerf 121 of the knockoff holes 120 may be that one part is discontinuous or multiple parts are discontinuous, which is determined by actual requirements.

In the present embodiment, the identification of each of the plurality of knockoff holes 120 is set in the knockoff hole 120, near the knockoff hole 120 or to surround the knockoff hole 120. During production, locations of the identifications of the knockoff holes 120 on the label 100 may be determined according to implementation.

In the present embodiment, the identification of the knockoff 120 is a word or a pattern. The identification of the knockoff hole 120 is not only identified through the word or pattern, but also can combine the shape of the knockoff hole 120 to indicate the identification of the cable represented by the knockoff hole 120, wherein the identification of a cable may be one, and may also be multiple.

In the present embodiment, a boss 130 is set on the cable label 100.

After determining the uses of the cable, according to the uses of the cable, corresponding identification is selected; the boss 130 on one cable label 100 is used to press the intermediate material 122 of the knockoff hole 120 corresponding to the identification of another cable label 100 and the intermediate material 122 is knocked off, and then a bundle buckle passes the corresponding through-hole 110 on the cable label 100, and the label 100 is bundled on the label 100.

In the present embodiment, the boss 130 on the cable label 100 is preferably set at one end of the label. During production, it is easily molded and convenient for use.

During usage, merely two cable labels 100 are used to mutually knock off the intermediate materials 122 of corresponding knockoff holes 120 through the boss 130, which does not need other tools to complete and is convenient for use.

The above description is only the example embodiments of the disclosure and is not intended to limit the patent scope of the disclosure.

Any transformation of equivalent structures made through using the specification and the accompanying drawings of the disclosure or being applied in other relevant technical fields directly or indirectly should be covered within the protection scope of the disclosure likewise.

What is claimed is:

1. A cable label, wherein the label is set with at least one through-hole for at least one bundle buckle to pass through and the label is further set with a plurality of knockoff holes, and each of the plurality of knockoff holes is formed of discontinuous annular kerf, and is set with an identification, wherein the identifications of the each of the plurality of knockoff holes are different from each other;

wherein the label is set with a boss, which is used to press an intermediate material of a knockoff hole corresponding to an identification of another cable label;

wherein the boss is located at part of one end of the label and a width of the boss is smaller than a diameter of the knockoff hole.

2. The cable label according to claim 1, wherein at least one part of the discontinuous annular kerf is discontinuous.

3. The cable label according to claim 2, wherein the identification of each of the plurality of knockoff holes is set in the knockoff hole, near the knockoff hole or to surround the knockoff hole.

4. The cable label according to claim 1, wherein the identification of each of the plurality of knockoff holes is a combine use of a word and a shape of each of the plurality of knockoff holes.

* * * * *